United States Patent [19]

O'Donnell

[11] Patent Number: 4,892,170

[45] Date of Patent: Jan. 9, 1990

[54] PORTABLE LADDER ASSEMBLY

[75] Inventor: William P. O'Donnell, Nassau Bay, Tex.

[73] Assignee: Avanti International, Webster, Tex.

[21] Appl. No.: 344,060

[22] Filed: Apr. 27, 1989

[51] Int. Cl.[4] ..... B65D 90/10; E06C 1/36

[52] U.S. Cl. ..... 182/100; 182/128; 182/150; 182/189

[58] Field of Search ..... 182/100, 189, 150, 92, 182/128, 178

[56] References Cited

U.S. PATENT DOCUMENTS

| | | | |
|---|---|---|---|
| 1,248,189 | 11/1917 | Smith . | |
| 2,965,193 | 12/1960 | Murphy | 182/100 |
| 2,965,195 | 12/1960 | Paschen . | |
| 3,120,290 | 2/1964 | Kamrath . | |
| 3,869,742 | 3/1975 | Gale | 182/92 |
| 4,069,892 | 1/1978 | Lynne et al. . | |
| 4,146,114 | 3/1979 | Beavers . | |
| 4,355,701 | 10/1982 | Nicholson | 182/100 |
| 4,388,983 | 6/1983 | Bartels | 182/189 |
| 4,432,436 | 2/1984 | Suiter | 182/100 |
| 4,546,855 | 10/1985 | Lyons | 182/106 |

FOREIGN PATENT DOCUMENTS

| | | | |
|---|---|---|---|
| 8319615 | 12/1983 | Fed. Rep. of Germany . | |
| 8319616 | 12/1983 | Fed. Rep. of Germany . | |
| 484929 | 9/1953 | Italy | 182/189 |

OTHER PUBLICATIONS

"Another Pelsue Product for the Utilities", four pages by T. A. Pensue Co., Englewood, Colorado.
"Boom Hoist #300".
"Pompier", two pages.
"Report the Norwegian Building Research Institute", single page.
"The Lymas-Ladder", single page.

*Primary Examiner*—Reinaldo P. Machado
*Attorney, Agent, or Firm*—Browning, Bushman, Zamecki & Anderson

[57] ABSTRACT

A portable ladder assembly comprises a base, a supporting bracket, and a single rail ladder. The ladder assembly is particularly well suited for safely allowing human entry into a chamber with a confined area entry, such as a conventional manhole. The base member includes arms positionable on each side of the manhole entry for engaging a support surface, such as the ground, to prevent tipping of the ladder assembly. The bracket includes a rail receiving slot and a plurality of vertically spaced and downwardly directed rung receiving slots on opposing sides of the rail receiving slot. The ladder may be safely supported at various selected depths within the manhole by fitting the rail in selected rungs within their corresponding slots. The ladder assembly of the present invention does not significantly reduce the entry opening into the chamber, and may be safely used without being structurally dependent upon the manhole.

20 Claims, 2 Drawing Sheets

PORTABLE LADDER ASSEMBLY

BACKGROUND OF THE INVENTION

1. Field of the Invention

The present invention relates to ladders and support members for ladders and, more particularly, relates to a ladder assembly including a single rung ladder suitable for allowing access into a chamber with a confined area entry adjacent a support surface.

2. Description of the Prior Art

Subterranean chambers, such as manholes, are sometimes equipped with rungs permanently secured to the side walls of the chamber for facilitating personnel access into the chamber. The ladder effectively formed by such rungs is, however, expensive to manufacture and maintain, since the ladder is infrequently used during the life of the manhole. Also, such permanent rungs create a safety concern since the rungs can easily rust to the point of structural failure, and can become coated with dirt, grease, and other debris. Moreover, entry into the manhole is difficult and can be unsafe, since the person may not be properly supported until he descends far enough for his hands to grasp the top rung. Finally, rungs permanently positioned in a manhole are difficult to inspect, and are costly to repair.

Various types of portable ladders have been devised for allowing human access into chambers below a support surface for the ladder. Portable ladders are thus often used to allow repair personnel to enter a manhole to gain access to subterranean equipment, even in situations where the manhole was previously supplied with rungs permanently secured to the sidewalls of the manhole. Such portable ladders enable safer and easier access to the manhole, in that the ladder may extend upwardly from the ground level while in use. Moreover, the ladder assembly is portable and thus may be removed after the repair task is completed, and reused at another manhole. Between uses, the portable ladder assembly may be easily checked and, if necessary, cleaned and/or repaired. Thus those familiar with the cost of providing human access into subterranean chambers, such as manholes, recognize the low cost and safety benefits associated with portable ladders.

A significant problem with prior art portable ladders used for obtaining access to manholes relates to the confined area entry of the manhole. The opening to many manholes is only 22 inches in diameter, and the addition of a standard dual rail ladder into this restricted area makes human access, at best, difficult. The extension ladder disclosed in U.S. Pat. No. 1,248,189 is thus complicated and costly, and will practically prohibit an individual from entering a standard manhole.

U.S. Pat. No. 3,120,290 discloses a ladder assembly intended for manhole entry. The ladder contains standard spaced rails with each rung connected at one end to one of the rails. Accordingly, the ladder restricts the entry area into the manhole so that access is difficult or practically impossible. Moreover, apertures provided in the sides of each of the rails for facilitating depth adjustment of the ladder within the manhole substantially weaken the ladder, and are thus not permitted according to various governmental and/or industrial standards.

Another problem with portable ladder assemblies intended for enabling manhole entry relates to the necessary structural relationship between the manhole and the ladder assembly. The portable ladder disclosed in U.S. Pat. No. 2,965,195, for example, uses cutouts in a manhole riser to secure the ladder in place. Such cutouts not only increase the cost of a conventional manhole riser, but allow water to flow into the manhole. U.S. Pat. No. 4,146,144 discloses a manhole ladder assembly with dual rails which structurally cooperates with the manhole riser. Manholes often vary in design and size, however, and the ladder assembly can thus only be safely used with a manhole riser design similar to that shown in the patent. Accordingly, many existing manhole risers would have to be modified so that they could cooperate with the ladder assembly to serve its intended purpose. Similarly, a portable ladder entry system depicted in German references G8319615.3 and G8319616.1 apparently require that special components be affixed to the manhole riser and/or that the manhole riser cooperate with such components to enable the ladder assembly to be used.

A single rail ladder is disclosed in U.S. Pat. No. 4,069,892, which is suitable for use in wells and other vertical shafts. The ladder is, however, intended as a permanent installation in the well, and each end of the ladder includes a lug for fastening the ladder to sidewalls of the well. A single rail ladder referred to as a pompier ladder includes an upper hook with teeth. Although this ladder has the advantage of not substantially restricting the entry into a manhole, the ladder still requires that the upper hook be able to cooperate with the manhole riser to hold the ladder in place. Moreover, this type of ladder does not extend vertically substantially above the riser, and thus entry by personnel into the manhole is difficult.

The disadvantages of the prior art are overcome by the present invention, and an improved portable ladder apparatus is hereinafter disclosed which may be used for enabling access into a restricted area manhole without regard to the size, shape, design, or material of the manhole. The ladder meets various governmental and industry standards, and may be safely used with other rescue and material handling equipment intended to allow ingress or egress of personnel or equipment.

SUMMARY OF THE INVENTION

The portable ladder assembly of the present invention may be used for providing individual access into a chamber beneath a support surface. The portable ladder assembly may, for example, be understood when used to provide access into a manhole extending downward from the ground level. The components of the ladder assembly need not structurally cooperate with the manhole or the manhole riser, and thus the ladder may be easily used on various types of manholes having different sizes and shapes.

The ladder assembly includes a base with arms for positioning on opposite sides of a manhole, with each of the arms having a portion adapted for engagement with the support surface, such as the ground, to prevent the ladder assembly from tipping when in use. The assembly includes a single rail ladder having a plurality of rungs extending outwardly in opposite directions from the rail, with each of the rungs perpendicular to the central axis of the ladder rail. A supporting bracket is secured to the base, either fixedly or movably, and includes a rail receiving slot for receiving the ladder rail, and a plurality of vertically spaced and downwardly directed rung receiving slots on opposite sides of the rail receiving slot. The ladder may thus be obtained at a selected depth within the manhole by fitting the rail within the rail receiving slot, and fitting a selected pair of rungs within their respective slots in the supporting bracket.

It is an object of the present invention to provide a safe yet relatively inexpensive portable ladder for use in enabling access to various types of chambers positioned beneath a support surface.

It is another object of the present invention to provide an improved apparatus for supporting a single rail ladder in a well, including a bracket having a plurality of slots for receiving selected rungs of the ladder.

It is a feature of the present invention that the portable ladder apparatus may be reliably used to obtain entry to a chamber, such as a well, having a restricted area entry. The ladder assembly, when in place, need not significantly restrict the entry area into a manhole.

It is a further feature of the present invention that the ladder assembly need not structurally cooperate with any of the components forming the chamber, so that the ladder assembly may be reliably utilized to allow access to chambers of substantially different sizes and shapes.

An advantage of the present invention relates to its simplicity and thus reduce manufacturing costs, while allowing a portion of the ladder to extend above the ground or other support surface to facilitate ingress and egress of personnel.

These and further objects, features, and advantages of the present invention will become apparent from the following detailed description, wherein reference is made to the figures in the accompanying drawings.

DETAILED DESCRIPTION OF PREFERRED EMBODIMENTS

The portable ladder of the present invention may be used for gaining access to various chambers beneath a support surface for the ladder. The following description relates to a ladder specifically intended to allow individual ingress and egress from a subterranean well or manhole. It should be understood, however, that the concepts of the present invention may also be used to obtain access into various types of chambers, and are particularly well suited for obtaining access into chambers having restricted or confined area entries. The ladder of the present invention may thus be used for allowing access into various types of subterranean wells, service rooms with top-entry ports, or storage or railroad car tanks with removable top covers of a restricted size.

Figure 1:
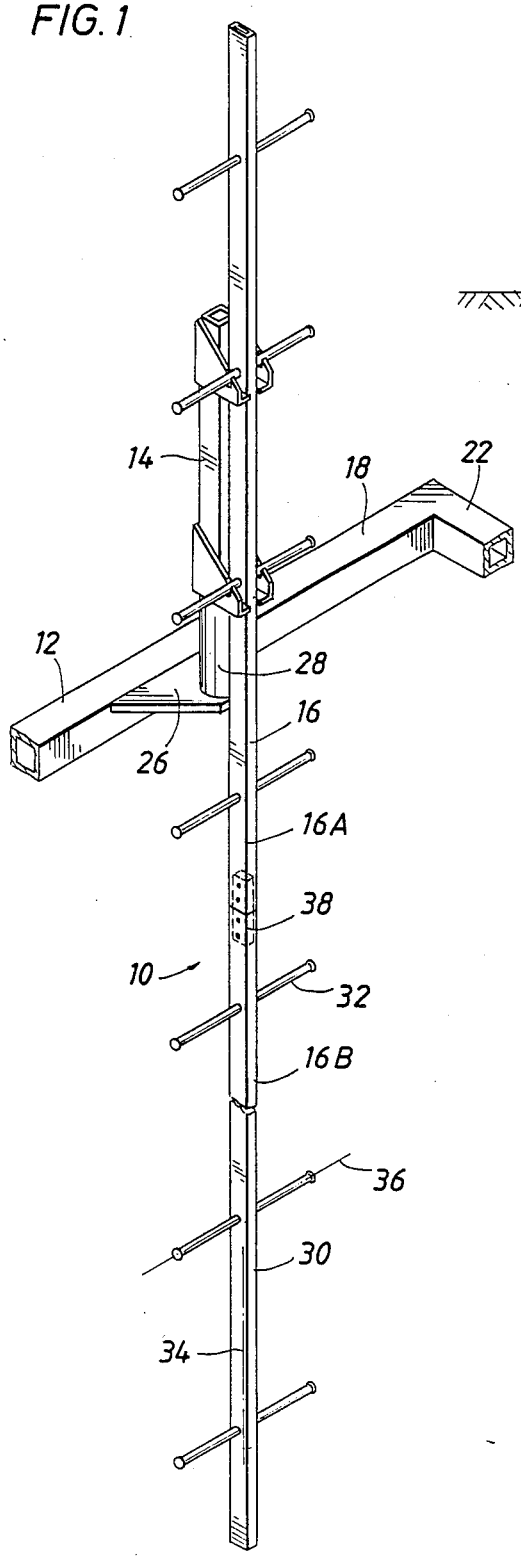
FIG. 1 is a pictorial view, partially in cross-section, of a suitable portable ladder assembly according to the present invention.
Figure 3:
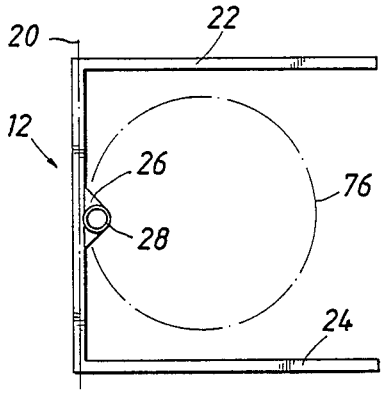
FIG. 3 is a top view of the base for the ladder assembly shown in FIG. 1.

Referring to FIG. 1, a ladder assembly 10 includes three primary components: a base 12, a supporting bracket 14, and a single rail ladder 16. The base 12 may be formed from structural rectangular tubular steel, and lies substantially in a horizontal plane for positioning on the ground about the manhole. Referring briefly to FIG. 3, the base 12 includes an elongate rearward member 18 having a central axis 20, and a pair of parallel arms 22 and 24, each weldably connected to and perpendicularly to the member 18. Gusset plates (not shown) may be used to form a more stout interconnection between the member 18 and the arms 22 and 24. Substantially the entire length of the arms 22 and 24 thus each engage the ground surface about the manhole when the assembly is in use, and prevent the assembly from tipping over when a man steps on the ladder.

FIGS. 1 and 3 also depict a generally triangular spacer plate 26 which positions the ladder closer to the manhole than the member 18. A tubular sleeve 28 is weldably secured to plate 26, and extends upwardly for receiving a lower end portion of the bracket 14, as explained subsequently.

The base 12 thus lies in a horizontal plane for engaging the planar supporting surface about the manhole, and has a substantially U-shaped configuration formed from three elongate tubular steel members. The base may, however, have various configurations, and may be in the shape of a rectangle, a circle, or an oval which either fully or partially encircles the manhole. If the supporting surface is not planar, as may be the case for the top of a railroad tank car adjacent the access port to the car, the base may be altered to a configuration substantially conforming to the supporting surface, thereby maintaining planar contact between the supporting surface and the base.

Although the base herein described is parallel to the supporting surface along substantially the entirety of its circumferential length, it should be understood that various other configurations for a base are within the scope of the invention. For example, the base may utilize a tripod or quadpod structure, with two legs of the tripod or quadpod extending on opposite sides of the manhole. Also, the base may take the form of a manhole ring or guard, such as a Pelsue guard used with many types of manholes.

Since the base of a ladder assembly according to the present invention may take on various configurations, it is a feature of the present invention that the base need not cooperate with any portion of the manhole to enable the ladder assembly to be reliably used to gain access into the manhole. The base should, however, provide a relatively inexpensive structure so that the bracket 14 may be reliably secured thereto, and will enable the bracket to maintain its position after the ladder has been positioned on the bracket and independent of whether the weight of a man is supported on the ladder.

The ladder 16 comprises a single elongate rail 30, which may lie along a central rail axis 34 and have a substantially rectangular cross-sectional configuration. A plurality of rungs 32 extend outwardly from opposite sides of the rail 30, with each rung having its axis 36 perpendicular to the rail axis 34. As shown in FIG. 1, the ladder may include ladder segments 16A and 16B, each having a plurality of rungs. The ladder segments may thus be joined by connection 38 to form the combined ladder with a functionally unitary rail lying along the rail axis 34.

Figure 6:
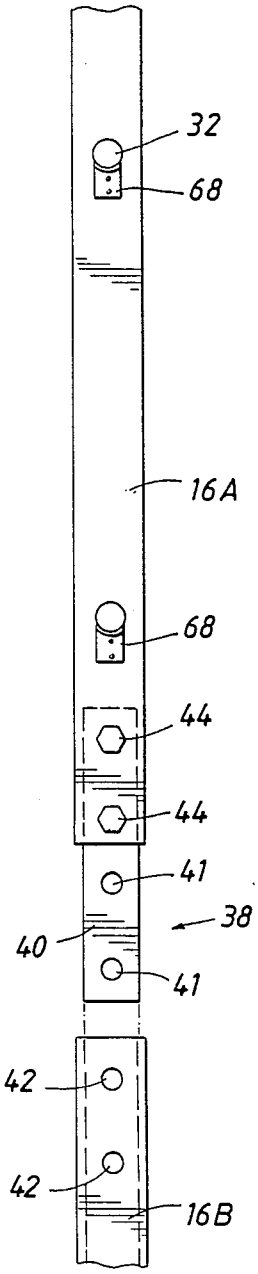
FIG. 6 is an exploded view of ladder segments adapted to be connected for forming the single rung ladder shown in FIG. 1.

FIG. 6 depicts the ends of ladder segments 16A and 16B aligned for connection by 38. Connection 38 comprises a bar 40 having a rectangular cross-section for fitting within the open ends of the ladder segments, and a plurality of holes 41. A pair of through passageways 42 in the ladder segments enable bolts or locking pins 44 to secure each end of the bar 40 to an end of a respective ladder segment. FIG. 6 thus depicts bar 40 secured to the ladder segment 16A, while ladder segments 16B is aligned for fitting over the remaining portion of the bar 40, and may thereafter be secured to the bar by similar bolts or pins 44.

It is a feature of the present invention that the ladder 16 have removable segments, so that the effective length of the ladder can be easily adjusted depending upon the depth of the manhole. It is also an advantage of the present invention, however, that the connection 38 and the ladder segments be configured so that each of the rungs along the length of the rail on the ladder be positioned so that rungs are the same distance, e.g., 12 inches, from adjacent rungs. Accordingly, this same spacing between the rungs is maintained between the lower rung of an upper ladder segment 16A, and an upper rung of a lower ladder segment 16B. This feature of the invention enables the ladder to be selectively positioned at various depths within the well, such that the bracket 14 may support two adjacent rungs of one ladder segment, or may support one rung of two ladder segments, without making any adjustments to the bracket 14.

Although the ladder shown in FIG. 1 and 6 is of the type that each of the rungs 32 extends through the rail, the portable ladder assembly of the present invention may include a unitary rail ladder with a staggered rung design, as shown in U.S. Pat. No. 4,069,892.

Figure 2:
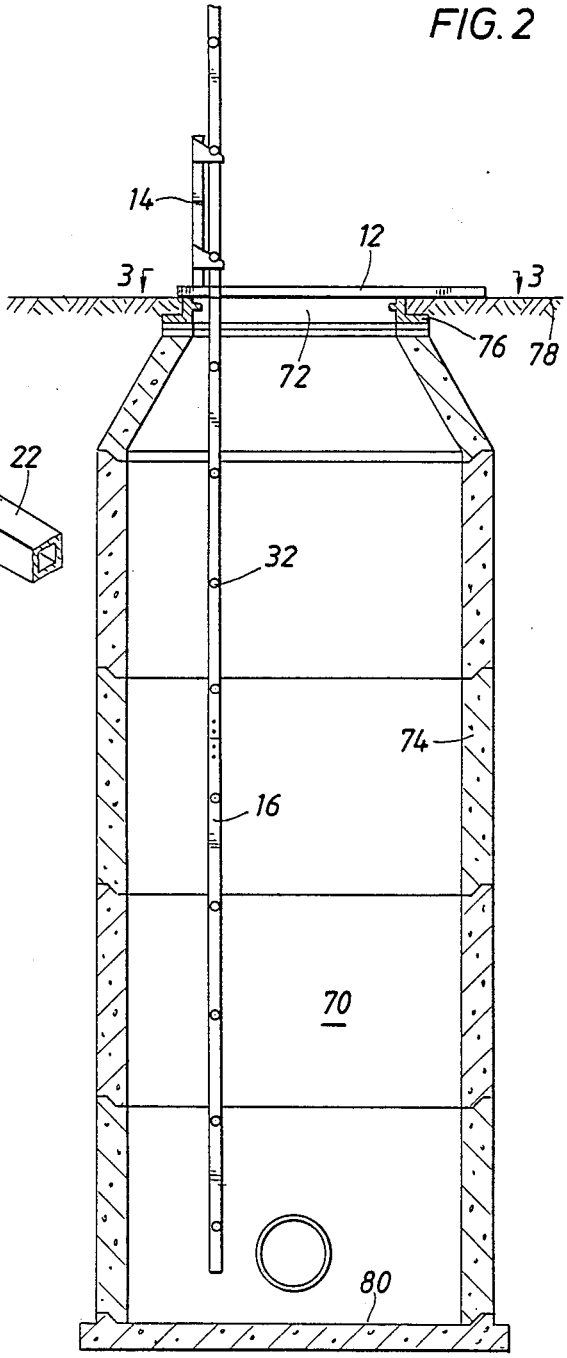
FIG. 2 is a side view illustrating the ladder as shown in FIG. 1 positioned for allowing access into a manhole.
Figure 4:
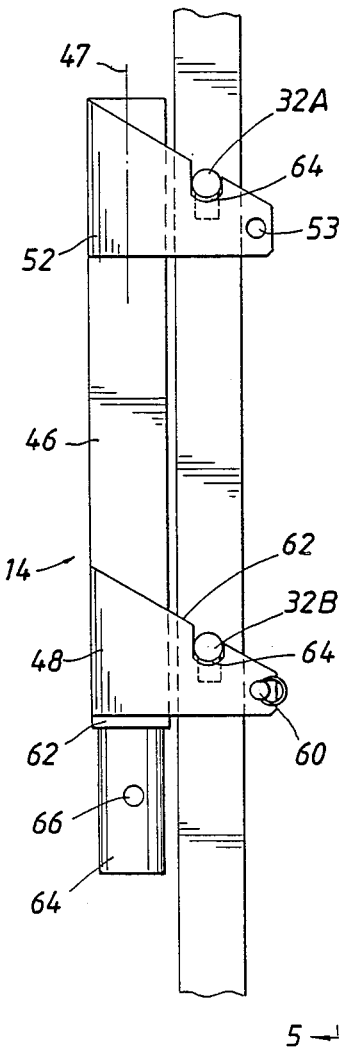
FIG. 4 is a side view of a suitable supporting bracket according to the present invention, illustrating a portion of a ladder supported thereon.
Figure 5:
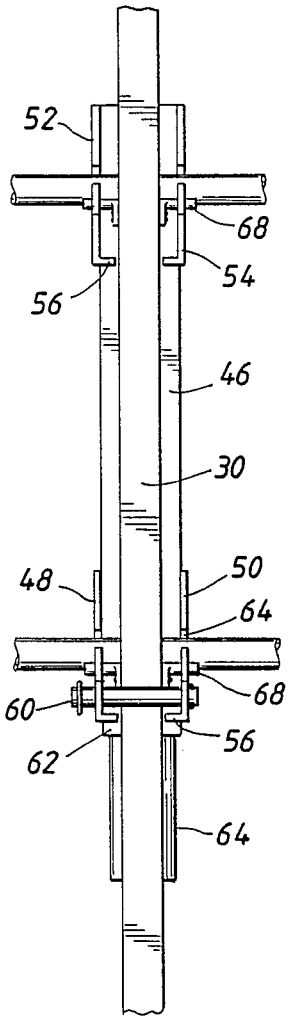
FIG. 5 is an end view of the apparatus depicted in FIG. 4.

FIGS. 4 and 5 depict the supporting bracket 14 generally shown in FIG. 2. The bracket comprises a vertical support member 46 which may be formed from rectangular structural tubular steel, a pair of lower plates 48 and 50 each weldably secured to support member 46, and a pair of upper plates 52 and 54 similarly secured to 46. Each of the plates 48, 50, 52 and 54 may have a generally triangular configuration as shown in FIG. 4, with an inwardly directed bend portion 56 to increase lateral strength. A plate 62 is welded to the lower end of support 46, and a pin 64 extends downwardly from 62 to be received within the tubular 28 of the frame 12. If desired, the pin 64 or other securing member may include a through passage 66 for alignment with a similar passageway in the tubular 28 to lock the bracket 14 to the frame 12. In any event, however, it should be understood that with the pin 64 in the tubular 28, the bracket 14 is removably yet safely secured to the frame in order to support the ladder 16 as well as the weight of a person on the ladder. During use, the axis 47 of the support 46 is parallel to and spaced closely to the axis 34 of the rail 30, so that a large torque is not applied to the plates even when a person is supported on the ladder.

A through passage 58 may be provided in each plate aligned with a similar passage in the corresponding upper or lower plates to receive a bolt or locking pin 60. A slot 64 in each of the plates has a width only slightly greater than the diameter of one of the rungs 32, and projects downwardly from the inclined edge 62 of the plates to receive a corresponding one of the rungs, as shown in FIG. 4 and 5. The upper edge 62 of each of the plates is preferably inclined so that the weight of a ladder resting on the edges 62 will automatically cause the rungs to slide downwardly along edge 62 and into a corresponding one of the slots 64. Once the rungs are fitted within their corresponding slots, the weight of the ladder will tend to maintain the ladder supported on the bracket 14. In addition, the weight of the person on the ladder will increase the downward force on the rungs 32, so that additional weight on a ladder increases the force which connects the ladder 16 and the bracket 14.

It should be understood that one rung 32A is thus supported on the upper pair of plates 52, 54 and within the slots 64 in those plates, while the rung 32B of the same ladder is supported on the lower pair of plates. The rung projecting from opposite sides of the rail 30 may be a unitary rung piece which passes through a slot in the rail, similar to the design of the pompier ladder. In this case, an angle bracket 68 as shown in FIGS. 5 and 6 may be used to interconnect the unitary rung to the rail. Alternatively, the rung may be welded or otherwise secured to the rail, and two separate and substantially aligned rung pieces may be used each projecting from an opposite side of the rail.

The apparatus of the present invention will now be briefly described for enabling access to a chamber 70, which is illustrated in FIG. 6 as a subterranean manhole having a resticted or confined area entry 72. In many applications, the side walls of the chamber 70 may be formed from concrete sections 74 and the entry is defined by a metal manhole cover support 76 (manhole cover removed in FIG. 6). The ladder assembly of the present invention may be used when the top of the manhole cover support 76 is equal with the ground level 78, but most importantly may also be used when the manhole cover 76 projects upwardly from the ground level 78, or is below the ground level 78.

The ladder assembly will typically be assembled at the manhole site from the primary components, which include the base 12, the supporting bracket 14, and ladder sections or segments. The operator will generally know or estimate the approximate depth to which the ladder should extend in the manhole, and may assemble two or more ladder segments to form a unitary rail ladder of a desired length. This assembling of the ladder sections may be in the manner as previously described with reference to FIG. 6.

After the ladder segments are assembled, the operator may position the base 12 about the manhole, such that the arms 22 and 24 are on radially opposite sides of the manhole (see FIG. 3). The operator may then place the pin 64 of the bracket 14 within the tubular 28 of the base, thereby securing the tubular member to the base. With both of the pins 60 removed from the plates, the ladder 16 may then be positioned so that two of the rungs 32 are supported on the corresponding upper and lower pair of plates. The operator may, of course, position the ladder on any selected two of the rungs, and may lower the ladder, if desired, so that it engages a surface 80 of the manhole, and then raise the ladder upward slightly so that it is supported on the next two rungs. Once the ladder is supported on the bracket 14, the pins 60 may be inserted, thereby safely securing the ladder on the bracket.

As shown in FIG. 6, an advantage of the present invention is that the ladder 16 need not contact the floor of the manhole when in use. In many cases, the floor of a manhole is unstable, uneven, or may be slippery, so that prior art ladders which are in part supported by the floor of the manhole create a safety concern. Also, it may be seen from FIG. 6 that the ladder assembly does not substantially restrict the entry into the manhole, and the unitary rail 30 of the ladder may, in fact, engage the edge of the manhole support plate 76. Also, it can be seen in FIG. 6 that one or more rungs 32 may be positioned vertically above the support 14 while the ladder is in use, and these rungs assist in enabling a person to easily and safely enter the manhole.

After use, the pins 60 may be removed, and the ladder 16 lifted vertically so that the rungs rise out of the slots 64 in the bracket 14. The ladder may then be returned to the surface and disassembled. The bracket 14 may also be disassembled from the base 12, and the apparatus then moved to a new location.

Various alterations to the bracket 14 herein described are within the concept of the invention. The base 12 may be altered so that two fixed and vertically spaced support bars are provided, so that the plates 48, 50, 52 and 54 may then be secured to these support bars. In this case, the vertical support 46 may thus be eliminated. Also, the function of the plates may be accomplished by various alternate structures. For example, spaced hook members with upwardly projecting end pieces could be provided, with the space between the hook members forming the rail receiving slot. In this case, the rung receiving slot would be effectively formed by the gap between the vertical support and the upwardly projecting end pieces. The slots 64 in the plates should be downwardly directed, so that the weight of the ladder assists in maintaining the rungs within the slots. The slots may, however, be angled rather than being vertical and, if angled, may be directed toward the support member 46 to force the ladder rail against the support member 46. Also, various locking or securing members other than the pin 60 could be provided between the pairs of plates to ensure that the ladder does not inadvertantly drop with respect to the bracket, even if the rungs were to come out of their respective rung receiving slots in the plates. With the exception of the removable bolt or pins 60, the bracket 14 described herein may be cast as a unitary member.

A feature of the present invention is that the configuration of the ladder, the bracket, and the base member allow for various manhole accessory equipment to be easily with or about the apparatus of this invention. For example, the simplistic design of the base allows guard rails and/or warning lights to be easily secured to the base without interfering with the operator's use of the ladder. Also, cable manhole rollers may be added to the base so that equipment can be easily lowered into or retrieved from the manhole. Since the single rail ladder occupies only a small portion of the manhole, the ladder may normally remain in the manhole while the cable rollers are used to maneuver equipment into and out of the manhole.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A portable ladder assembly for providing access to a manhole having a central axis and extending downward from a support surface, the ladder assembly comprising:

a base member including first and second arms positionable on radially opposite sides of the central axis of the opened manhole, each of the first and second arms having a portion adapted for engagement with the support surface to prevent the ladder assembly from tipping;

a ladder including a single elongate rail having a central rail axis and a plurality of rungs fixed to and extending in opposite directions outwardly from the rail, each rung extending outwardly from the rail along a rung axis substantially perpendicular to the central axis of the rail; and a supporting bracket secured to the base member and having a rail receiving slot and a plurality of vertically spaced and downwardly directed rung receiving slots on opposing sides of the rail receiving slot, such that the ladder may be supported at a selected depth within the manhole by fitting the rail within the rail receiving slot and fitting a selected pair of rungs within their respective rung receiving slots.

2. A portable ladder assembly as defined in claim 1, further comprising:

a securing member removably connected with the supporting bracket for prohibiting the rail of the ladder from moving out of the rail receiving slot.

3. A portable ladder assembly as defined in claim 2, wherein the supporting bracket further comprises:

a pair of substantially lower planar plates spaced apart to define the rail receiving slot and including at least one of the plurality of rung receiving slots for receiving a respective rung of the ladder; and a pair of substantially planar upper plates spaced apart to define the rail receiving slot and including at least one of the plurality of rung receiving slots for receiving a respective rung of the ladder.

4. A portable ladder assembly as defined in claim 3, wherein:

each of the plates of one of the pair of lower or upper plates includes a through passageway; and the securing member is a pin removably positionable within the through passageway of each of the pair of plates for prohibiting the rail from moving out of the rail receiving slot.

5. A portable ladder assembly as defined in claim 2, wherein the supporting bracket further comprises:

a substantially vertical support having an axis substantially parallel to the central axis of the rail; and the pair of substantially lower plates and the pair of substantially parallel upper plates are each fixedly secured to the substantially vertical support.

6. A portable ladder assembly as defined in claim 2, wherein:

an upper edge of each of the pair of lower and upper plates vertically above a corresponding rung receiving slot is inclined for engaging a corresponding rung and allowing the rung to slide by gravity along the inclined upper edge of the plate and into the corresponding slot.

7. A portable ladder assembly as defined in claim 5, wherein the base member lies in a substantially horizontal plane, and substantially the entire length of each of the first and second arms is adapted for engagement with the support surface.

8. A portable ladder assembly as defined in claim 7, wherein:

the base comprises an elongate rear support having a rear support axis; and each of the first and second arms are elongate members each having an arm axis substantially perpendicular to the rear support axis.

9. A portable ladder assembly as defined in claim 8, further comprising:

a spacer fixed between the base member and the vertical support for positioning the vertical support closer to the central axis of the manhole than the base member.

10. A portable ladder assembly as defined in claim 1, wherein the ladder comprises:

a plurality of ladder segments each having a single rail and a plurality of rungs interconnected therewith;

an interconnection member for interconnecting rail ends of ladder segments to form a combination rail along the central rail axis; and the interconnection member being spaced from and independent of any rungs on the combination rail, such that a lower rung of an upper ladder segment may fit within an upper rung receiving slot in the bracket, and an upper rung of a lower ladder segment may fit within a lower rung receiving slot in the bracket.

11. A portable ladder assembly for providing access to a chamber having a central axis and extending downward from a support surface, the ladder assembly comprising:

base means including first and second arms positionable on radially opposite sides of the central axis of the chamber, each of the first and second arms having a portion adapted for engagement with the support surface to prevent the ladder assembly from tipping;

ladder means including a single elongate rail having a central rail axis and a plurality of rungs fixed to and extending in opposite directions outwardly from the rail;

support bracket means secured to the base means and having a rail receiving slot and a plurality of vertically spaced and downwardly directed rung receiving slots on opposing sides of the rail receiving slot, such that the ladder may be supported at a selected depth within the chamber by fitting the rail within the rail receiving slot and fitting a selected pair of rungs within their respective rung receiving slots; and securing means removably connected with the support bracket means for prohibiting the rail of the ladder means from moving out of the rail receiving slot.

12. A portable ladder assembly as defined in claim 11, wherein the support bracket means further comprises:

a pair of substantially lower planar plates spaced apart to define the rail receiving slots and including at least one of the plurality of rung receiving slots for receiving a respective rung of the ladder means;

a pair of substantially planar upper plates spaced apart to define the rail receiving slots and including at least one of the plurality of rung receiving slots for receiving a respective rung of the ladder means; and each of the plates of one of the pair of lower or upper plates includes a through passageway for receiving the securing means.

13. A portable ladder assembly as defined in claim 12, wherein the support bracket means further comprises:

a substantially vertical support having an axis substantially parallel to the central axis of the rail; and the pair of substantially lower plates and the pair of substantially parallel upper plates are each fixedly secured to the substantially vertical support.

14. A portable ladder assembly as defined in claim 11, wherein the base means lies in a substantially horizontal plane, and substantially the entire length of each of the first and second arms is adapted for engagement with the support surface.

15. A portable ladder assembly as defined in claim 11, wherein the ladder means comprises:

a plurality of ladder segments each having a single rail and a plurality of rungs interconnected therewith;

an interconnection means for interconnecting rail ends of ladder segments to form a combination rail along the central axis; and the interconnection means being spaced from and independent of any rungs on the combination rail, such that a lower rung of an upper ladder segment may fit within an upper rung receiving slot in the bracket means, and an upper rung of a lower ladder segment may fit within a lower rung receiving slot in the bracket means.

16. A portable ladder assembly for providing access to a chamber having an opening, the portable ladder assembly comprising:

a base positionable adjacent the opening for the chamber to prevent the ladder assembly from tipping;

a ladder including a single elongate rail having a central rail axis and a plurality of rungs fixed to and extending in opposite directions outwardly from the rail; and a supporting bracket secured to the base and having a rail receiving slot and a plurality of vertically spaced and downwardly directed rung receiving slots on opposing sides of the rail receiving slot, such that the ladder may be supported at a selected depth within the chamber by fitting the rail within the rail receiving slot and fitting a selected pair of rungs within their respective rung receiving slots.

17. A portable ladder assembly as defined in claim 16, further comprising:

a securing member removably connected with the supporting bracket for prohibiting the rail of the ladder from moving out of the rail receiving slot.

18. A portable ladder assembly as defined in claim 17, wherein the supporting bracket further comprises:

a pair of substantially lower planar plates spaced apart to define the rail receiving slot and including at least one of the plurality of rung receiving slots for receiving a respective rung of the ladder;

a pair of substantially planar upper plates spaced apart to define the rail receiving slot and including at least one of the plurality of rung receiving slots for receiving a respective rung of the ladder; and each of the plates of one of the pair of lower or upper plates includes a through passageway for receiving the securing member.

19. A portable ladder assembly as defined in claim 17, wherein the supporting bracket further comprises:

a substantially vertical support having an axis substantially parallel to a central axis of the rail; and the pair of substantially lower plates and the pair of substantially parallel upper plates are each fixedly secured to the substantially vertical support.

20. A portable ladder assembly as defined in claim 17, wherein the ladder comprises:

a plurality of ladder segments each having a single rail and a plurality of rungs interconnected therewith;

an interconnection member for interconnecting rail ends of ladder segments to form a combination rail along a central rail axis; and the interconnection member being spaced from and independent of any rungs on the combination rail, such that a lower rung of an upper ladder segment may fit within an upper rung receiving slot in the bracket, and an upper rung of a lower ladder segment may fit within a lower rung receiving slot in the bracket.

* * * * *